United States Patent [19]

Lofquist et al.

[11] 4,105,404

[45] * Aug. 8, 1978

[54] SUBSTITUTED THIOUREAS TO INHIBIT OZONE FADING OF DYED POLYAMIDES

[75] Inventors: Robert Alden Lofquist; Peter Reginald Saunders, both of Richmond, Va.

[73] Assignee: Allied Chemical Corporation, Morris Township, Morris County, N.J.

[ * ] Notice: The portion of the term of this patent subsequent to Jul. 9, 1974, has been disclaimed.

[21] Appl. No.: 402,543

[22] Filed: Oct. 1, 1973

Related U.S. Application Data

[63] Continuation-in-part of Ser. No. 233,792, Mar. 10, 1972, abandoned.

[51] Int. Cl.[2] ..... D06P 5/02

[52] U.S. Cl. ..... 8/165; 8/74

[58] Field of Search ..... 8/165, 74

[56] References Cited

U.S. PATENT DOCUMENTS

| | | | |
|---|---|---|---|
| 1,985,248 | 12/1934 | Ellis | 8/165 |
| 2,583,370 | 1/1952 | Goppel et al. | 260/769 |
| 3,024,218 | 3/1962 | Steven | 260/769 |
| 3,584,993 | 6/1971 | Myles | 8/165 |
| 3,822,996 | 7/1974 | Lofquist et al. | 8/74 X |

OTHER PUBLICATIONS

Salvin, *American Dyestuff Reporter,* 1952, pp. 297–303.
Salvin, *Amer. Dyestuff Rep.,* Feb. 1968, pp. 156–159.
American Dyestuff Reporter, pp. 33–41, 1/6/64.
Textile Research J., vol. XXV, No. 7, Jul. 1955, pp. 571–585.

*Primary Examiner*—Donald Levy
*Attorney, Agent, or Firm*—Richard A. Anderson

[57] ABSTRACT

When from about 0.5% to about 5% of N,N'-disubstituted thioureas are coated on nylon fiber, improved dyefastness is achieved compared to an untreated dyed nylon fiber when this fiber is exposed to ozone.

7 Claims, No Drawings

SUBSTITUTED THIOUREAS TO INHIBIT OZONE FADING OF DYED POLYAMIDES

BACKGROUND OF THE INVENTION

This is a continuation-in-part of Application Ser. No. 233,792, filed Mar. 10, 1972 now abandoned.

The object of this invention is to reduce or prevent the fading of dyed nylon fabrics, such as nylon carpets, caused by ozone.

Ozone is generally present in air at sea level at concentrations of only 1 to 5 parts per hundred million (pphm). Only under conditions of heavy smog, where sunlight acts on a combination of unburned hydrocarbons from gasoline and oxides of nitrogen does the ozone concentration exceed these concentrations. However, even at the low ozone concentrations, if the humidity is high enough (e. g., over 75% R.H.), ozone fading occurs.

Ozone is a molecular form of oxygen which has three atoms of oxygen instead of the normal two atoms of oxygen per molecule. It is a very powerful oxidizing agent; and a strong electrophilic reagent, that is, it searches out and attacks electron pairs such as exist with carbon-carbon double bonds.

Dyes have a multiplicity of double bonds, and perhaps for this reason are very sensitive to ozone.

The dyes in nylon which are most seriously attacked are those which are mobile in the nylon, such as disperse dyes. Cationic dyes are also susceptible. The most sensitive dyes are anthraquinone based, particularly blue dyes having an anthraquinone nucleus although there is evidence that under high humidity and high ozone concentration, almost all dyes are affected by ozone.

High humidity is necessary to cause noticeable ozone fading. Apparently moisture permits the dye to have sufficient mobility to diffuse to the surface of the yarn where the destruction of the dye occurs.

A number of chemicals have been called antiozonants in the literature which protect rubber from ozone. Examples are paraphenylenediamine derivatives, and dihydroquinoline derivatives. In nylon, however, these chemicals seriously discolor the yarn, especially after exposure to light, severely limiting the use of such materials.

SUMMARY OF THE INVENTION

A method and composition have been found for improving the fastness of dyes when exposed to ozone in polycarbonamide fibers. The method consists of coating the fibers with N,N'-bis alkyl thioureas of the formula

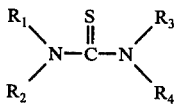

where $R_1$, $R_2$, $R_3$ and $R_4$ are independently selected from benzyl, cyclohexyl, hydrogen or a straight chain staurated alkyl having one to eight carbon atoms, said compound containing at least five carbon atoms. The thioureas of this invention are incorporated in the spin finish, in the overfinish prior to dyeing or sprayed in solution onto a dyed sleeve of nylon 6, or nylon 6,6. These thioureas, substantive for polycarbonamides and water insoluble, so remain with the fiber or yarn after subsequent water treatment such as, scouring and/or shampooing and compete with the dye for the ozone, thus decreasing the rate of destruction of the dye.

The rate of fading of the dye in nylon fibers, particularly disperse or cationic anthraquinone dyes, is substantially reduced by the incorporation or coating of these thioureas. This reduction of fading is particularly useful on dyed carpets.

DESCRIPTION OF THE PREFERRED EMBODIMENTS

Some of the preferred embodiments of this invention are set forth in the following examples. The method of testing for ozone fading is similar to the AATCC Test 129-1968 set forth on page 334/15 of *The Journal of American Association of Textile Chemists and Colorists,* July 30, 1969, Volume 1, No. 16, in an article entitled, "A New Test Method for Ozone Fading at High Humidity", by Victor S. Salvin.

The method and the means of measuring the loss of dye consists in dyeing the yarn with a selected dye or dyes, exposing it to ozone at a concentration of 80 parts per hundred million in a test chamber together with a control nylon sample which was dyed an avocado shade. The control sample is examined periodically until the resulting color corresponds to that of the Standard of Fading (one cycle). It has been found that one cycle is completed when the internal standard has faded sufficiently to give a $\Delta E$ of 2.8, compared to the unexposed standard.

$\Delta E$ is a measure of the change of color between two samples, a smaller $\Delta E$ being a closer match, or less fading of one sample compared to the second sample.

This color difference, $\Delta E$ was measured with a Hunterlab Color Difference Meter. This instrument measures color as seen in average daylight in a manner similar to the way in which the human eye responds to the stimulus of color. Experimentation has shown that the eye can match any color with a combination of three "primary" colored lights, and therefore, that any color can be specified by a three dimensional identification. The Color Difference Meter measures the light reflected by a specimen through filters that correspond to the three "primary" lights. These measurements made correspond to the way the average human eye responds to light.

$$\Delta E = \sqrt{(\Delta L)^2 + (\Delta a)^2 + (\Delta b)^2}$$

where $\Delta L$ is $L_1 - L_2$ $\Delta a$ is $a_1 - a_2$ $\Delta b$ is $b_1 - b_2$ and $L$, $a$, and $b$ are readings on the Hunterlab Color Difference Meter.

"$L$" is a 100 to 0 reading of white to black;

"$a$" indicates redness when positive, gray when zero, and green when negative;

"$b$" indicates yellow when positive, gray when zero and blue when negative.

The following are examples of the subject additives and their behavior on being coating onto yarn, dyed and exposed to ozone, or on being coated on dyed sleeves and exposed to ozone.

EXAMPLE I

Polymer made from caprolactam, having a formic acid relative viscosity of 46, about 81 sulfonic groups from sodium sulfoisophthalate, about 90 carboxyls and about 25 amine ends per million grams of polymer, was spun into yarn. The yarn, coated with a commercial aqueous spin finish was drawn at a draw ratio of 2.9. The yarn had a Y cross-section with a 3.2 modification ratio and each filament had a denier of 15.

The yarn was chopped into 7-inch lengths, carded and spun into staple yarn having a cotton count of 2. The yarn was knitted into sleeves, and heat set by steam treating in an autoclave at 230° F. for five minutes followed by three 10-minute cycles of steam treatment at 260° F.

The sleeves were dyed to a moss green in a dye bath composed as follows:

0.3% Sevron Yellow 8GMF (DuPont) (CI Basic Yellow 53)

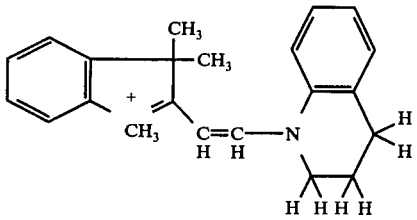

0.25% Astrazon Blue 3RL (Verona) (CI Basic Blue 47)

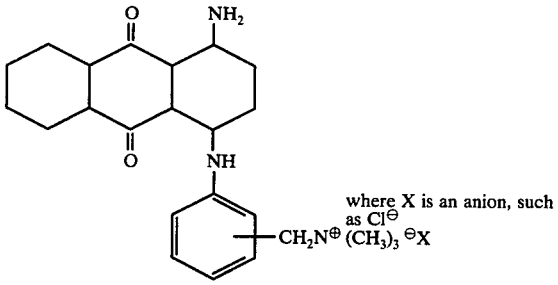

2.0% Hipochem PND-11 amine salt of alcohol ester by Highpoint Chemical Company, 1.0% Hipochem CDL-60, nonionic surfactant by Highpoint Chemical Company, (chemical structure not available) and monosodium and/or disodium phosphate to adjust the pH to 7.0 ± 0.2.

The sleeve was cut into sections about 5 inches long and each section was weighed. The sleeves were then dipped in the methanol solutions shown below for 20 minutes. The sleeves were then removed from the solutions, dried and reweighed. The amount of material coated on the sleeves from each solution was based on the difference in weight between the coated and the uncoated sleeves, compared to the control.

The sleeves were then exposed to three cycles of ozone in an atmosphere of about 80 parts per hundred million of ozone at a temperature of 104° F., at a relative humidity of at least 95%. A cycle is that exposure which is completed when the internal nylon standard, dyed olive I, has faded sufficiently to give a ΔE of 2.8. The measurement ΔE is dicussed under "Description of Preferred Embodiments".

The solutions, the amount of coating and the results of ozone exposure are listed as follows:

| | % Pickup | ΔE |
|---|---|---|
| (a) Control 200 ml dimethylformamide | 0 | 10.3 |
| (b) 1 gram 1,3-di-n-butyl-2-thiourea | 0.4 | 2.3 |
| (c) 3 grams 1,3-di-n-butyl-2-thiourea | 1.6 | 0.9 |
| (d) 1 gram 1,3-dicyclohexyl-2-thiourea | 0.6 | 1.3 |
| (e) 3 grams 1,3-dicyclohexyl-2-thiourea | 2.0 | 1.6 |
| (f) 1 gram 1,3-dibenzyl-2-thiourea | 0.6 | 8.1 |
| (g) 3 grams 1,3-dibenzyl-2-thiourea | 2.1 | 4.5 |

EXAMPLE II

Sleeves similar to those described in Example I, but undyed, were coated with the chemicals in solution listed below, dyed as in Example I and then exposed to ozone as described in Example I.

| | % Pickup | ΔE |
|---|---|---|
| (a) Control 200 ml ethyl acetate | 0 | 18.2 |
| (b) 3 grams 1,3-dibenzyl-2-thiourea in 200 cc ethyl acetate | 2.6 | 4.9 |
| (c) 3 grams 1,3-di-n-butyl-2-thiourea in 200 cc ethyl acetate | 2.4 | 5.8 |
| (d) 1 gram 1,3-di-n-butyl-2-thiourea in 200 cc ethyl acetate | 0.8 | 8.3 |
| (e) 0.5 gram 1,3-di-n-butyl-2-thiourea in 200 cc ethyl acetate | 0.3 | 15.1 |
| (f) 1.0 gram 1,3-dicylohexyl-2-thiourea in 200 cc ethyl acetate | 0.9 | 7.8 |

EXAMPLE III

Polymer made from caprolactam having a formic acid viscosity of about 70, about 60 carboxyls and about 15 amines per million grams of polymer, was spun into yarn. The yarn, coated with a commercial aqueous spin finish, was drawn at a draw ratio of about 3.0. The yarn had a Y cross-section with a 3.0 modification ratio and each filament had a denier of 15.

The yarn was chopped into 7-inch lengths, carded and spun into staple yarn having a cotton count of 2. The yarn was knitted into sleeves, and heat set by treatment similar to that given the sleeves in Example I.

The sleeves were dyed to an Olive I shade, a tertiary shade which consists of 0.069% O.W.F. (on weight of fiber) C. I. Disperse Blue 3, such as Celliton Blue FFRN (C. I. No. 61505), 0.0807% O.W.F. Celliton Pink RF (C. I. No. 60755), and 0.465% O.W.F. Celliton Yellow GA (C. I. No. 11855). Disperse Blue 3 dye is especially sensitive to ozone. The dyed sleeves were then dipped in the solutions of chemicals listed below, in order to coat them with the chemicals.

The coated dyed sleeve was then exposed to an atmosphere containing about 80 pphm of ozone at a temperature of 104° F. at about 95% relative humidity for three fading cycles.

The results of this exposure were:

| | Percent | ΔE |
|---|---|---|
| (a) 1.0 gram 1,3-di-n-butylthiourea in 200 ml dimethylformamide (DMF) | 0.5 | 3.0 |
| (b) 2.0 grams 1,3-di-n-butylthiourea in 200 ml DMF | 2.1 | 1.6 |
| (c) 1.0 gram 1,3-di-cyclohexylthiourea in 200 ml DMF | 0.7 | 1.6 |
| (d) 2.0 grams 1,3-di-cyclohexylthiourea in 200 ml water | 1.5 | 1.8 |
| (e) Control - 200 ml DMF | —16.5 | |

We claim:

1. A method for improving fastness of dyes when exposed to ozone in nylon fibers dyed with anthraquinone dyes consisting of coating said fibers with a substance consisting essentially of a compound having the formula

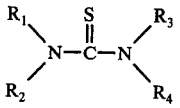

where $R_1$ is an alkyl having one to eight carbon atoms and $R_2$, $R_3$ and $R_4$ are independently selected from hydrogen or an alkyl having one to eight carbon atoms, said compound containing at last five carbon atoms, so that from about 0.5 to about 5% on weight of fiber of the compound remains on said fiber after subsequent water treatment to substantially reduce the rate of fading due to exposure of fabric of said dyed fiber to ozone.

2. The method of claim 1 wherein said coating is applied prior to dyeing said fiber.

3. The method of claim 1 wherein said coating is applied subsequent to dyeing said fiber.

4. The method of claim 1 wherein said anthraquinone dyes are disperse dyes.

5. The method of claim 1 wherein said anthraquinone dyes are basic dyes.

6. A nylon fabric dyed with anthraquinone dyes coated with from about 0.5 to about 5% on weight of fabric of a substance consisting essentially of a compound having the formula

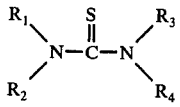

where $R_1$ is an alkyl having one to eight carbon atoms and $R_2$, $R_3$ and $R_4$ are independently selected from hydrogen or an alkyl having one to eight carbon atoms, said compound containing at least five carbon atoms, said compound being substantive to polycarbonamides and whereby said compound substantially reduces the rate of fading due to exposure of said fabric to ozone.

7. The fabric of claim 6 wherein said fabric is carpet.

* * * * *